United States Patent [19]

Wilson et al.

[11] Patent Number: 4,748,368

[45] Date of Patent: May 31, 1988

[54] THREE WAY GAS DISCHARGE LAMP

[75] Inventors: William E. Wilson, Clifton; Edward W. Morton, Teaneck; Daniel W. O'Mullan, Bloomfield, all of N.J.

[73] Assignee: North American Philips Lighting Corporation, New York, N.Y.

[21] Appl. No.: 686,871

[22] Filed: Dec. 27, 1984

[51] Int. Cl.[4] ..... H01J 61/34; H01J 61/92; H05B 31/04; H05B 41/18

[52] U.S. Cl. ..... 313/1; 313/25; 313/493; 313/634; 315/178; 315/184; 315/191

[58] Field of Search ..... 313/25, 1, 3, 6, 493, 313/634; 315/178, 184, 191; 362/225, 265, 216

[56] References Cited

U.S. PATENT DOCUMENTS 1,706,091 3/1929 Wiegand ..... 362/216
4,388,562 6/1983 Josephson ..... 315/178 X

FOREIGN PATENT DOCUMENTS 845617 8/1960 United Kingdom ..... 313/25

*Primary Examiner*—David K. Moore
*Assistant Examiner*—K. Wieder

[57] ABSTRACT

A three way lamp having two gas discharge light tubes mounted on the same housing in a light-transmitting bulb.

4 Claims, 1 Drawing Sheet

THREE WAY GAS DISCHARGE LAMP

This is an invention in lighting. More particularly, it involves a gas discharge type lighting device.

Recently it has become desirable to provide gas discharge type lights in packages which permits them to be used as replacements for incandescent lamps. One of the advantages of these types of gas discharge lighting devices is the increased lumen-to-watts ratio over incandescent lamps. They also have longer life than incandescent lamps which they can replace.

One of the objects of this invention is to provide a novel gas discharge type light as a replacement for incandescent lamps.

One of the features of the invention is the provision of two gas discharge tubes in the same light transmitting bulb.

An advantage of the invention is the ability of the two tube arrangement to serve as a three-way lamp.

In accordance with one embodiment of the invention there is provided a three-way lamp comprising a housing having three terminals. The housing includes a light transmitting bulb containing two gas discharge light tubes. Each tube has two electrodes and each has its electrodes connected to a different pair of the terminals on the housing.

In accordance with another embodiment of the invention there is provided a lamp comprising a housing with a light transmitting bulb. The bulb contains two U-shaped gas discharge tubes. One of the tubes is a larger U than the other. The tubes are orthogonally mounted in the bulb with the larger tube over the smaller.

Other objects, features and advantages of the invention will become apparent to those skilled in the art from the following description and appended claims when considered in conjunction with the accompanying drawing in which:

Figure 3:
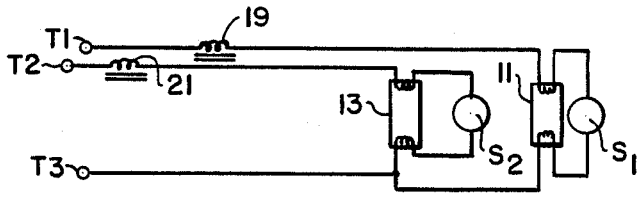
Figure 4:
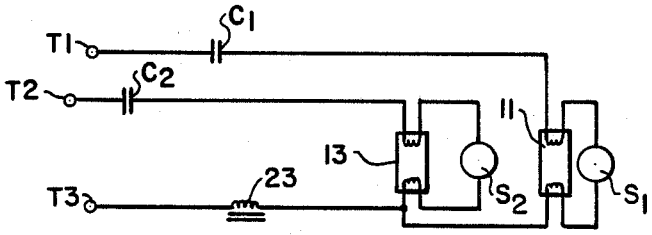

FIG. 3. is a schematic diagram of one way in which the lamp of the invention may be connected to power lines; and FIG. 4 is an alternative schematic diagram for connecting the lamp of the invention to power lines.

Figure 1:
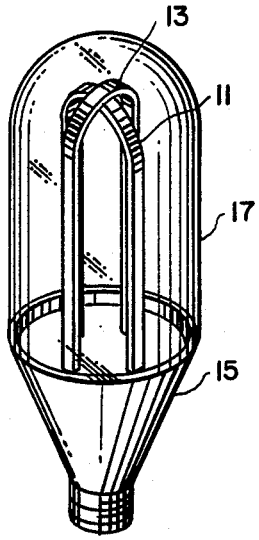
FIG. 1 is a profile of a lamp made in accordance with the invention.

Referring to FIG. 1 there is shown a lamp which in accordance with the invention contains gas discharge tube 11 and gas discharge tube 13 both mounted in housing 15. Gas discharge tubes 11 and 13 are under light transmissive bulb 17 which constitutes the upper half of housing 15. The lower half of housing 15 contains the ballast for gas discharge tubes 11 and 13.

Figure 2:
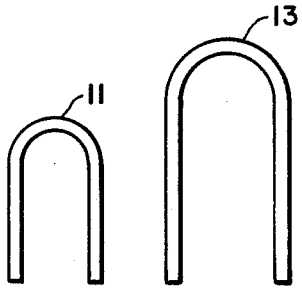
FIG. 2 shows the two U-shaped discharge light tubes of the invention.

As can be seen from FIG. 2 both tubes 11 and 13 are U-shaped. Tube 13 forms a larger U than tube 11. This permits the tubes to be mounted orthogonally under bulb 17 with tube 13 over tube 11.

One arrangement for connecting tubes 11 and 13 to the power supply is shown in FIG. 3. One terminal T1 of the lamp is connected to ballast coil 19 which is connected to one of the electrodes of tube 11. This electrode is connected in series to starter S1 which in turn is connected to one lead of the other electrode of tube 11. The other lead of the second electrode of tube 11 is connected to common terminal T3. Terminal T2 of the lamp is connected to ballast coil 21 which is connected to one electrode of tube 13. This electrode is connected in series to starter S2 which in turn is connected to one lead of the second electrode of tube 13. The other lead of the second electrode of tube 13 is connected to common terminal T3 of the lamp.

In operation if terminals T1 and T3 are connected to the power supply tube 11 is lighted. If terminals T2 and T3 are connected to the power supply tube 13 is lighted. When terminals T1, T2 and T3 are all connected to the power supply tubes 11 and 13 are both lighted.

In the alternate circuitry of FIG. 4 terminal T1 is connected to capacitor C1 which is used to boost the voltage to tube 11. Capacitor C1 is connected to one electrode of tube 11 which is also connected to one terminal of starter S1. The other terminal of starter S1 is connected to the second electrode of tube 11. This electrode is connected to ballast coil 23 which in turn is connected to common terminal T3. Terminal T2 of the lamp is connected to capacitor C2 which is used to boost the voltage to tube 13. Capacitor C2 is connected to one electrode of tube 13 which is connected to one terminal of starter S2. The other terminal of starter S2 is connected to the other electrode of tube 13 which is also connected to ballast coil 23. As previously stated coil 23 is connected to common terminal T3. In operation, if terminals T1 and T3 are connected to the power supply tube 11 is lighted. If terminals T2 and T3 are connected to the power supply tube 13 is lighted. If all terminals T1, T2 and T3 are connected to the power supply both tubes 11 and 13 are lighted.

It is to be understood that terminals T1, T2 and T3 are provided on housing 15 in the manner in which similar type terminals would be provided on a typical three-way incandescent lamp. Various modifications to the above described arrangement of the invention will become evident to those skilled in the art. The arrangement described herein is for illustrative purposes and is not to be considered restrictive.

What is claimed is:

1. A three-way lamp comprising a housing having first, second and third terminals arranged thereon as provided on a three-way incandescent lamp, said lamp including a light-transmitting bulb, and two gas discharge light tubes in said bulb, each tube having two electrodes, one tube having its electrodes separately connected to said first and third terminals, the other tube having its electrodes separately connected to said second and third terminals.

2. A three-way lamp as claimed in claim 1, wherein each gas discharge tube is U-shaped.

3. A three-way lamp as claimed in claim 2, wherein one gas discharge tube is a larger U than the other.

4. A three-way lamp as claimed in claim 3, wherein said gas discharge tubes are orthogonally mounted in said bulb with the larger tube over the smaller.

* * * * *